US011299248B2

(12) United States Patent
Kadobayashi et al.

(10) Patent No.: US 11,299,248 B2
(45) Date of Patent: Apr. 12, 2022

(54) CONTROL SYSTEM AND CONTROL METHOD FOR OUTBOARD MOTOR

(71) Applicant: YAMAHA HATSUDOKI KABUSHIKI KAISHA, Iwata (JP)

(72) Inventors: Yoshiyuki Kadobayashi, Iwata (JP); Takeshi Ito, Iwata (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 0 days.

(21) Appl. No.: 17/039,406

(22) Filed: Sep. 30, 2020

(65) Prior Publication Data

US 2021/0147054 A1 May 20, 2021

(30) Foreign Application Priority Data

Nov. 15, 2019 (JP) ..... JP2019-207077

(51) Int. Cl.

| | |
|---|---|
| ***B63H 21/21*** | (2006.01) |
| ***B63H 20/12*** | (2006.01) |
| ***B63H 20/14*** | (2006.01) |
| ***B63H 20/10*** | (2006.01) |
| *B63H 20/00* | (2006.01) |

(52) U.S. Cl.

CPC ..... *B63H 21/21* (2013.01); *B63H 20/10* (2013.01); *B63H 20/12* (2013.01); *B63H 20/14* (2013.01); *B63H 2020/003* (2013.01); *B63H 2021/216* (2013.01)

(58) Field of Classification Search

CPC .. B63H 21/21; B63H 2021/216; B63H 20/10; B63H 20/12; B63H 20/14; B63H 2020/003

See application file for complete search history.

(56) References Cited

U.S. PATENT DOCUMENTS

| | | | | |
|---|---|---|---|---|
| 6,273,771 | B1 * | 8/2001 | Buckley | B63H 21/213 114/144 RE |
| 2021/0173413 | A1 * | 6/2021 | Derginer | G05D 1/0875 |

* cited by examiner

*Primary Examiner* — Stephen P Avila
(74) *Attorney, Agent, or Firm* — Rabin & Berdo, P.C.

(57) ABSTRACT

A control system includes an outboard motor, a sway sensor, and a controller. The outboard motor includes a power source and a propeller shaft. The power source includes a rotating shaft. The propeller shaft is connected to the rotating shaft. The sway sensor outputs a signal indicative of the sway of the boat. The controller is communicatively connected to the sway sensor. The controller receives the signal indicative of the sway of the boat. The controller controls at least one of a moment of inertia of the rotating shaft around the rotating shaft, a rotation speed of the rotating shaft, or a tilt angle of the rotating shaft according to the sway of the boat to generate an inertial force against the sway of the boat.

15 Claims, 14 Drawing Sheets

CONTROL SYSTEM AND CONTROL METHOD FOR OUTBOARD MOTOR

CROSS-REFERENCE TO RELATED APPLICATIONS

This application is based upon and claims the benefit of priority of the prior Japanese Patent Application No. 2019-207077, filed on Nov. 15, 2019, the entire contents of which are incorporated herein by reference.

BACKGROUND

Field of the Invention

The present invention relates to a control system and a control method for an outboard motor for reducing sway of a boat.

Background Information

Sway occurs on a boat due to an influence of waves or wind. Some boats have gyro stabilizers mounted to suppress the sway of the boat. The gyro stabilizer includes a gyro and a motor. The gyro stabilizer generates an inertial force against the sway of the boat by rotating the gyro with the motor.

SUMMARY

In order to obtain a great effect of suppressing the sway of the boat by the gyro stabilizer, the gyro becomes large. Therefore, the gyro stabilizer occupies a large space in the boat.

A control system according to a first aspect of the present disclosure is a control system for reducing sway of a boat. The control system includes an outboard motor, a sway sensor, and a controller. The outboard motor includes a power source and a propeller shaft. The power source includes a rotating shaft. The propeller shaft is connected to the rotating shaft. The sway sensor outputs a signal indicative of the sway of the boat. The controller is communicatively connected to the sway sensor. The controller receives the signal indicative of the sway of the boat. The controller controls at least one of a moment of inertia of the rotating shaft around the rotating shaft, a rotation speed of the rotating shaft, and a posture of the rotating shaft according to the sway of the boat to generate an inertial force against the sway of the boat.

A control system according to a second aspect of the present disclosure is a control system for reducing sway of a boat. The control system includes a first outboard motor, a second outboard motor, a sway sensor, and a controller. The first outboard motor includes a first power source and a first propeller shaft. The first power source includes a first rotating shaft. The first propeller shaft is connected to the first rotating shaft. The second outboard motor includes a second power source and a second propeller shaft. The second power source includes a second rotating shaft. The second propeller shaft is connected to the second rotating shaft. The sway sensor outputs a signal indicative of the sway of the boat. The controller is communicatively connected to the sway sensor. The controller receives the signal indicative of the sway of the boat. The controller controls at least one of a moment of inertia of the first rotating shaft around the first rotating shaft, a rotation speed of the first rotating shaft, and a posture of the first rotating shaft, and at least one of a moment of inertia of the second rotating shaft around the second rotating shaft, a rotation speed of the second rotating shaft, and a posture of the second rotating shaft according to the sway of the boat to generate an inertial force against the sway of the boat.

A method according to a third aspect of the present disclosure is a method for controlling an outboard motor to reduce sway of a boat. The outboard motor includes a power source and a propeller. The power source includes a rotating shaft. The propeller shaft is connected to the rotating shaft. The method includes the following processes. A first process is receiving a signal indicative of sway of the boat. A second process is controlling at least one of a moment of inertia of the rotating shaft around the rotating shaft, a rotation speed of the rotating shaft, and a posture of the rotating shaft according to the sway of the boat to generate an inertial force against the sway of the boat.

DETAILED DESCRIPTION OF EMBODIMENTS

Figure 1:
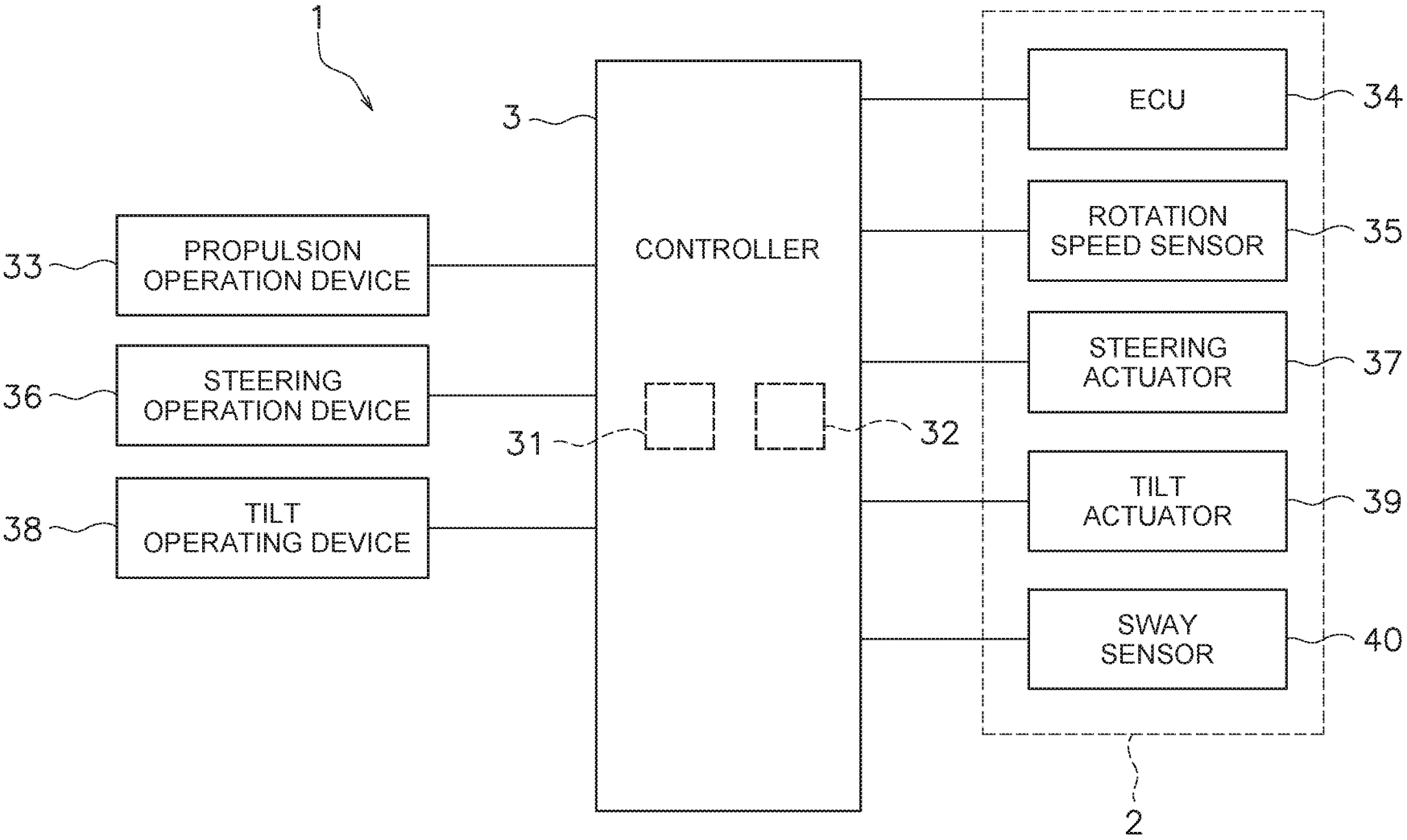
FIG. 1 is a block diagram showing a configuration of a control system according to an embodiment.
Figure 2:
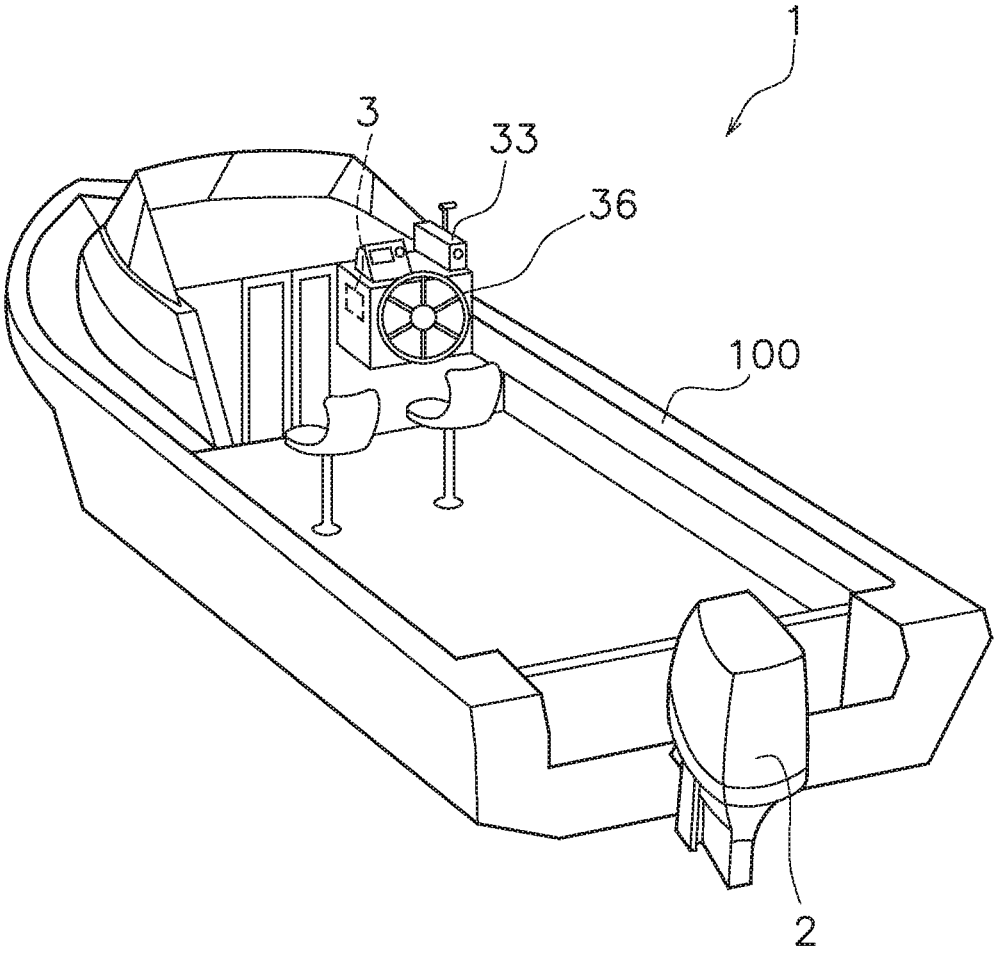
FIG. 2 is a perspective view of a boat equipped with the control system.
Figure 3:
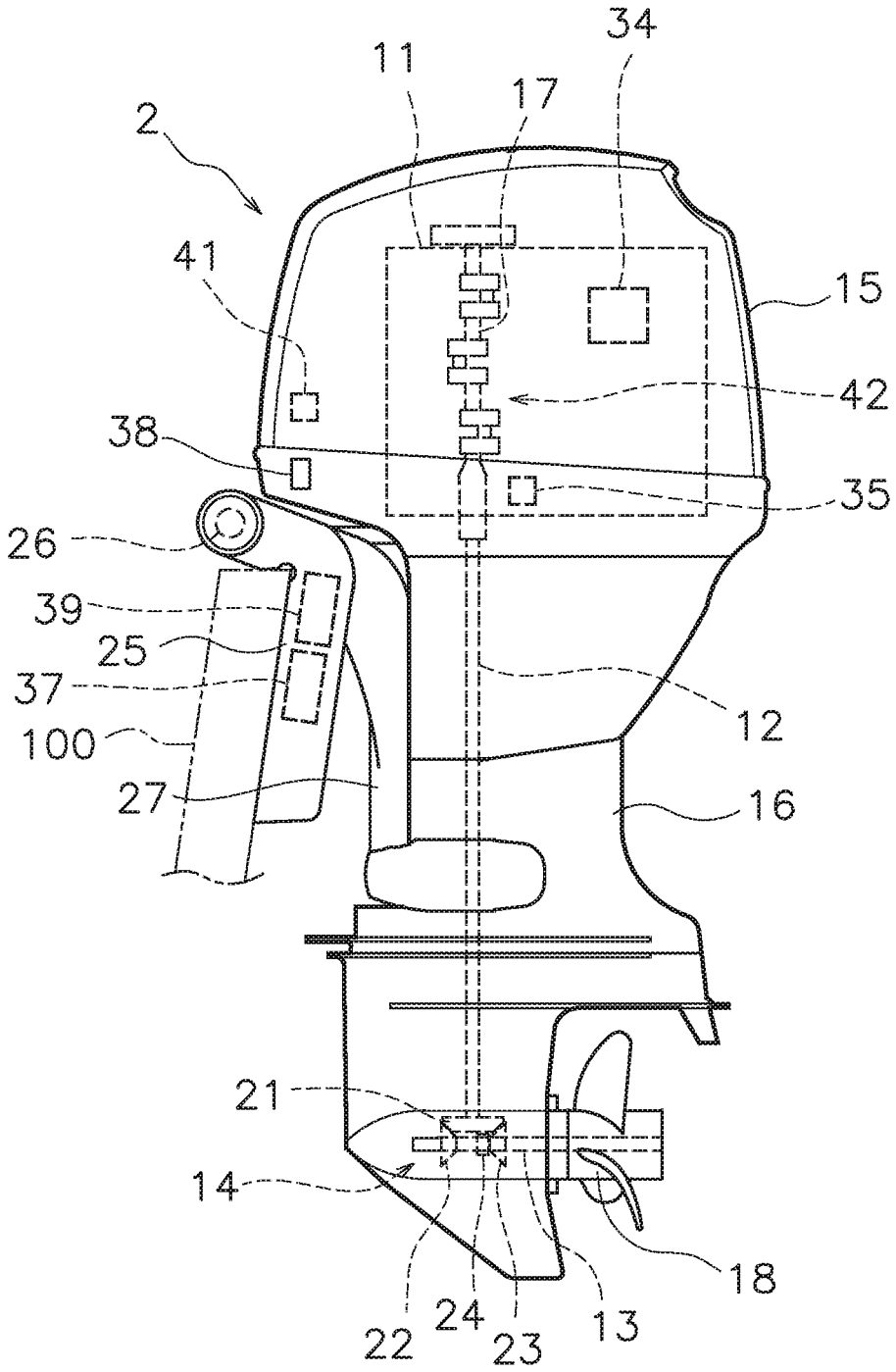
FIG. 3 is a side view of an outboard motor.

Hereinafter, embodiments will be described with reference to the drawings. FIG. 1 is a block diagram showing a configuration of a control system 1 according to an embodiment. FIG. 2 is a perspective view of a boat 100 equipped with the control system 1. As illustrated in FIGS. 1 and 2, the control system 1 includes an outboard motor 2 and a controller 3. FIG. 3 is a side view of the outboard motor 2. As illustrated in FIG. 3, the outboard motor 2 includes a power source 11, a drive shaft 12, a propeller shaft 13, a shift mechanism 14, a cowl 15, and a housing 16. In the following description, the front, rear, left, right, upper and lower directions mean the front, rear, left, right, upper and lower directions of the outboard motor 2.

The power source 11 generates a propulsive force that propels the boat 100. The power source 11 is, for example, an internal combustion engine. The power source 11 is arranged in the cowl 15. The power source 11 includes a crankshaft 17. The crankshaft 17 extends in the vertical direction. The drive shaft 12 is connected to the crankshaft 17. The drive shaft 12 extends in the vertical direction. The propeller shaft 13 extends in a direction intersecting with the drive shaft 12. The propeller shaft 13 extends in the front-rear direction. The propeller shaft 13 is connected to the drive shaft 12 via a shift mechanism 14. A propeller 18 is connected to the propeller shaft 13.

The housing 16 is arranged below the cowl 15. The drive shaft 12 is arranged in the upper portion of the housing 16. The propeller shaft 13 and the shift mechanism 14 are arranged in the lower portion of the housing 16. The shift mechanism 14 switches the rotation direction of the drive force transmitted from the drive shaft 12 to the propeller shaft 13. The shift mechanism 14 includes, for example, a drive gear 21, a forward gear 22, a reverse gear 23, and a shift clutch 24. The drive gear 21 is connected to the drive shaft 12. The forward gear 22 and the reverse gear 23 mesh with the drive gear 21. The shift clutch 24 switches connection and disengagement of the forward gear 22 and the reverse gear 23 with respect to the propeller shaft 13.

The shift clutch 24 is movable to a forward position, a reverse position, and a neutral position. The shift clutch 24 connects the forward gear 22 to the propeller shaft 13 and releases the reverse gear 23 from the propeller shaft 13 in the forward position. As a result, the rotation of the drive shaft 12 is transmitted to the propeller shaft 13 in the forward direction. The boat 100 moves forward as the propeller shaft 13 rotates in the forward direction. The shift clutch 24 connects the reverse gear 23 to the propeller shaft 13 in the reverse position and releases the forward gear 22 from the propeller shaft 13. As a result, the rotation of the drive shaft 12 is transmitted to the propeller shaft 13 in the reverse direction. The boat 100 moves backward as the propeller shaft 13 rotates in the reverse direction. The shift clutch 24 disengages the forward gear 22 and the reverse gear 23 from the propeller shaft 13 in the neutral position. Therefore, the rotation of the drive shaft 12 is not transmitted to the propeller shaft 13.

The outboard motor 2 includes a bracket 25. The outboard motor 2 is attached to the boat 100 via the bracket 25. The bracket 25 includes a tilt shaft 26. The tilt shaft 26 extends in the left-right direction of the outboard motor 2. The outboard motor 2 is supported by the bracket 25 so as to be rotatable around the tilt shaft 26. The bracket 25 includes a steering shaft 27. The steering shaft 27 extends in the vertical direction of the outboard motor 2. The outboard motor 2 is supported by the bracket 25 so as to be rotatable around the steering shaft 27.

The controller 3 is programmed to control the outboard motor 2. The controller 3 may be mounted on the boat 100. Alternatively, the controller 3 may be mounted on the outboard motor 2. The controller 3 includes a processor 31 and a memory 32. The memory 32 stores programs and data for controlling the outboard motor 2. The processor 31 is, for example, a CPU (Central Processing Unit). The processor 31 executes a process for controlling the outboard motor 2 according to the programs and the data.

As illustrated in FIG. 1, the control system 1 includes a propulsion operation device 33, an ECU 34 (Electronic Control Unit), and a rotation speed sensor 35. The propulsion operation device 33 includes a propulsion operation member such as a lever or a switch. The propulsion operation device 33 outputs a signal indicative of the position of the propulsion operation member. The ECU 34 controls the power source 11. The ECU 34 receives the signal indicative of the position of the propulsion operation member. The ECU 34 controls the output of the power source 11 according to the position of the propulsion operation member. For example, if the power source 11 is an engine, the ECU 34 controls the throttle opening degree according to the position of the propulsion operation member. If the power source 11 is an electric motor, the ECU 34 controls the input voltage to the electric motor according to the position of the propulsion operation member. The rotation speed sensor 35 outputs a signal indicative of the rotation speed of the crankshaft 17. The ECU 34 receives the signal indicative of the rotation speed of the crankshaft 17.

The control system 1 includes a steering operation device 36 and a steering actuator 37. The steering operation device 36 includes a steering operation member such as a steering wheel or a switch. The steering operation device 36 outputs a signal according to the position of the steering operation member. The steering actuator 37 moves the outboard motor 2 around the steering shaft 27. As a result, the steering angle of the outboard motor 2 is changed. The steering angle is the angle of inclination of the propeller shaft 13 in the left-right direction with respect to the front-back direction of the boat 100. The steering actuator 37 is, for example, an electric motor. Alternatively, the steering actuator 37 may be another actuator such as a hydraulic motor or a hydraulic cylinder. The controller 3 receives a signal indicative of the position of the steering operation member. The controller 3 changes the steering angle according to the position of the steering operation member. The controller 3 changes the steering angle by controlling the steering actuator 37.

The control system 1 includes a tilt operating device 38 and a tilt actuator 39. The tilt operating device 38 includes a tilt operation member such as a switch. The tilt operating device 38 outputs a signal according to the operation of the tilt operation member. The tilt actuator 39 moves the outboard motor 2 around the tilt shaft 26. As a result, the tilt angle of the outboard motor 2 is changed. The tilt angle is an oblique angle of the drive shaft 12 with respect to the vertical direction of the boat 100. The tilt actuator 39 is, for example, an electric motor. Alternatively, the tilt actuator 39 may be another actuator such as a hydraulic motor or a hydraulic cylinder. The controller 3 receives the signal indicative of the operation of the tilt operation member. The controller 3 changes the tilt angle according to the position of the tilt operation member. The controller 3 changes the tilt angle by controlling the tilt actuator 39.

The control system 1 includes a sway sensor 41. The sway sensor 41 detects sway of the boat 100 and outputs a detection signal indicative of the sway of the boat 100. The detection signal indicates the magnitude of the sway of the boat 100 and the direction of the sway. The sway sensor 41 may be mounted on the outboard motor 2. Alternatively, the sway sensor 41 may be mounted on the boat 100.

Figure 4:
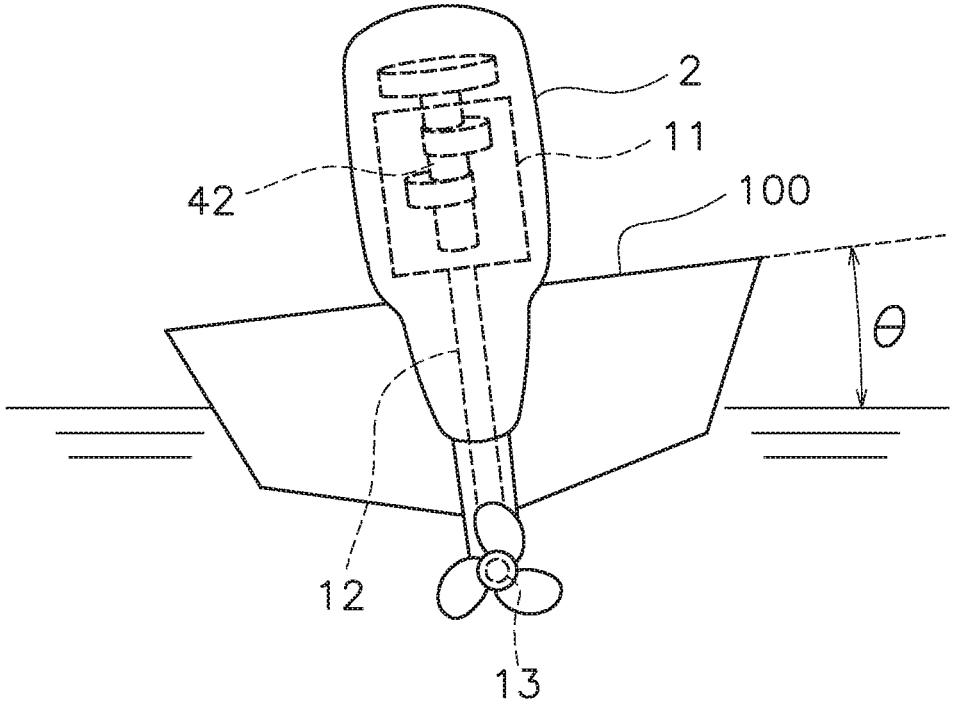
FIG. 4 is a rear view of the boat and the outboard motor.

FIG. 4 is a rear view of the boat 100 and the outboard motor 2. As illustrated in FIG. 4, the magnitude of the sway is indicated by the inclination angle θ of the boat 100 or the outboard motor 2 with respect to the horizontal direction, for example. The direction of the sway indicates, for example, the front-rear direction, the left-right direction, or the direction between the front-rear direction and the left-right direction of the boat 100. The sway sensor 41 is, for example, an IMU. However, the sway sensor 41 may be a sensor such as a gyroscope or an acceleration sensor. The controller 3 is communicatively connected to the sway sensor 41. The controller 3 is connected to the sway sensor 41 by wire or wirelessly. The controller 3 executes control for reducing the sway of the boat 100. Hereinafter, the control for reducing the sway of the boat 100 by the controller 3 will be described.

Figure 5:
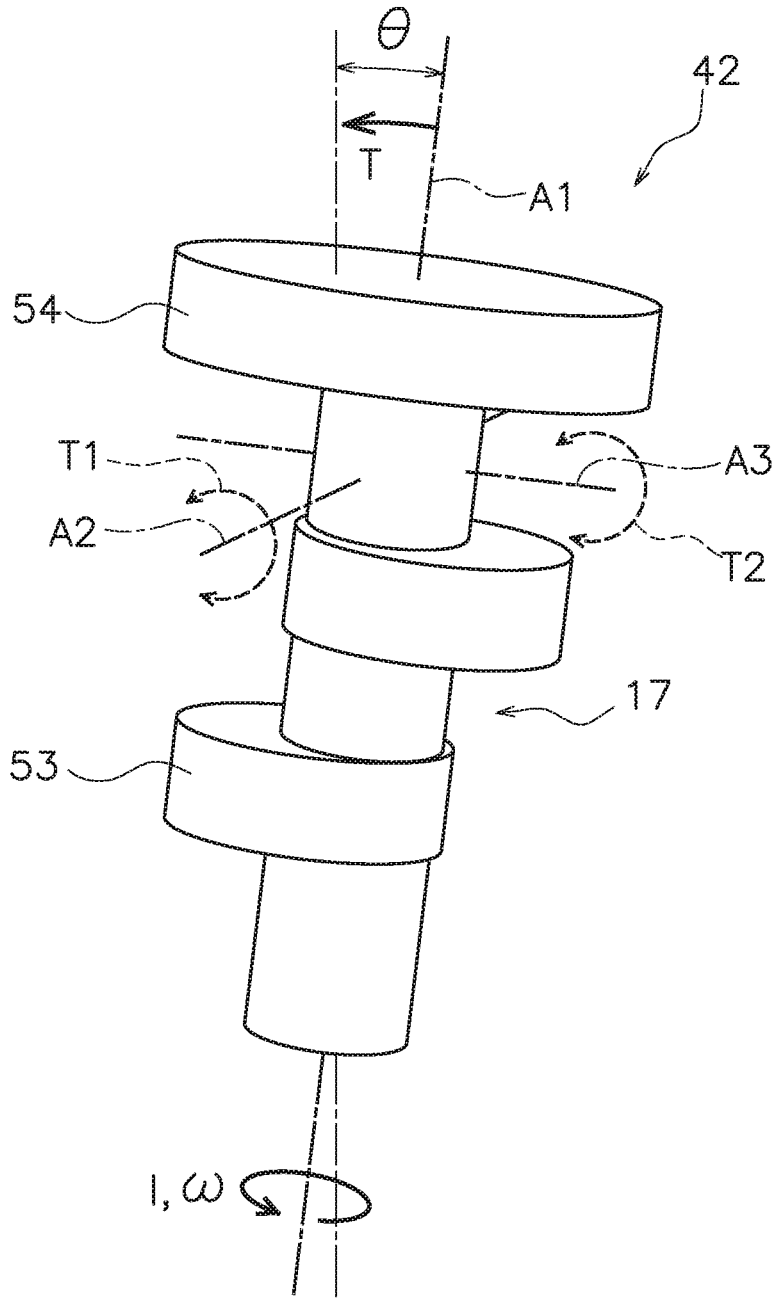
FIG. 5 is a schematic view of a rotating shaft.

The outboard motor 2 includes a rotating shaft 42 illustrated in FIG. 5. In FIG. 5, the rotating shaft 42 is schematically illustrated. The rotating shaft 42 includes at least the crankshaft 17 described above. The rotating shaft 42 may include the crankshaft 17 and a part or the whole of the drive shaft 12. The rotating shaft 42 extends in the vertical direction of the outboard motor 2. When the rotating shaft 42 tilts due to the sway of the boat 100, moment of inertias T1 and T2 act on the rotating shaft 42 about the central axes A2 and A3 due to the gyro effect of the rotating shaft 42. The central axes A2 and A3 are central axes orthogonal to the rotation axis A1 of the tilted rotating shaft 42. As illustrated in the following equation (1), the magnitudes of the moment of inertias T1 and T2 are changed according to the moment of inertia I of the rotating shaft 42, the rotation speed ω, and the change rate of the tilt angle θ (hereinafter, "posture change speed").

$$T1, T2 = I \times \omega \times \dot{\theta} \quad (1)$$

"I" is the moment of inertia around the rotation axis A1 of the rotating shaft 42. "ω" is the angular acceleration of the rotating shaft 42 around the rotation axis A1. "θ" is the inclination angle of the rotating shaft 42 with respect to the direction of gravity. The inclination angle θ corresponds to the magnitude of the sway of the boat 100.

The controller 3 controls at least one of the moment of inertia of the rotating shaft 42, the rotation speed, and the posture according to the sway of the boat 100 to generate a moment of inertia against the sway of the boat 100. The controller 3 may automatically start the control for reducing the sway of the boat 100. For example, the controller 3 may automatically start the control for reducing the sway of the boat 100 when the magnitude of the sway becomes equal to or larger than a predetermined threshold value. Alternatively, the controller 3 may start the control for reducing the sway of the boat 100 in response to a manual operation by an operator.

Figure 6:
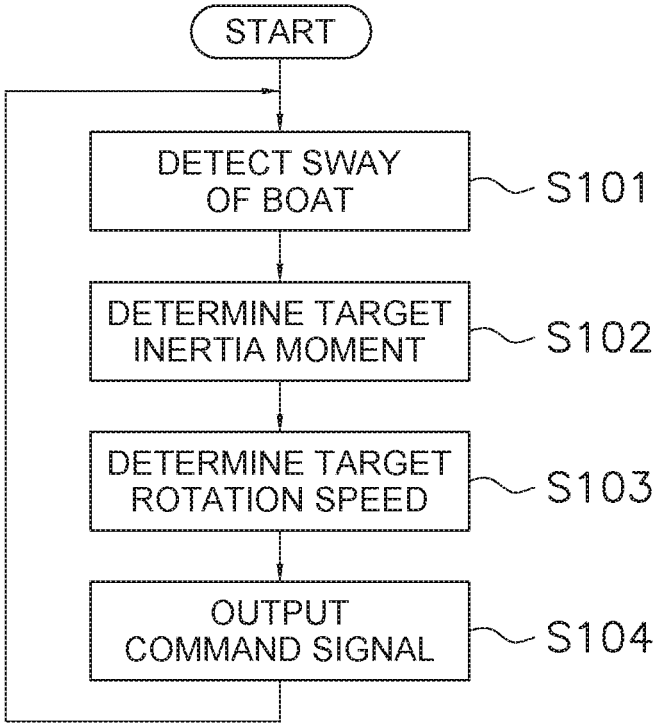
FIG. 6 is a flowchart showing a control process according to a first embodiment.

FIG. 6 is a flowchart showing a control process according to the first embodiment. In the first embodiment, the controller 3 controls the rotation speed of the rotating shaft 42 according to the sway of the boat 100 to generate a moment of inertia against the sway of the boat 100. As illustrated in FIG. 6, in step S101, the controller 3 detects the sway of the boat 100. The controller 3 detects the sway of the boat 100 based on the detection signal from the sway sensor 41.

In step S102, the controller 3 determines the target moment of inertia of the rotating shaft 42 according to the sway of the boat 100. The controller 3 may determine the target moment of inertia by the above equation (1). In step S103, the controller 3 determines the target rotation speed. The controller 3 determines the target rotation speed from the target moment of inertia. For example, the controller 3 determines the target rotation speed that increases as the sway increases.

In step S104, the controller 3 outputs a command signal for the power source 11. The controller 3 outputs the command signal indicative of the target rotation speed to the ECU 34. The ECU 34 controls the power source 11 so that the rotation speed of the rotating shaft 42 matches the target rotation speed. After that, the controller 3 repeats steps S101 to S104. Thereby, the rotation speed of the rotating shaft 42 is controlled according to the magnitude of the sway of the boat 100. For example, as the sway of the boat 100 increases, the controller 3 increases the rotation speed of the rotating shaft 42. As a result, a moment having a direction and magnitude that cancels the sway of the boat 100 acts on the rotating shaft 42. Thereby, the sway of the boat 100 is reduced.

The controller 3 may control the shift clutch 24 to release the propeller shaft 13 from the rotating shaft 42 when executing the control for reducing the sway of the boat 100. For example, the controller 3 may hold the shift clutch 24 in the neutral position when executing the control for reducing the sway of the boat 100.

Figure 7:
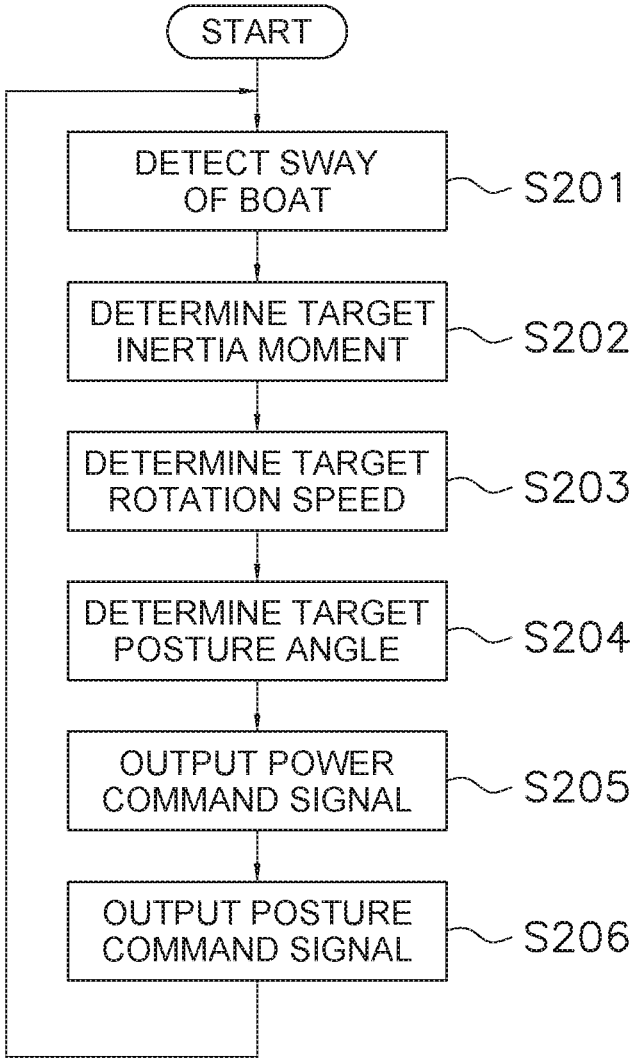
FIG. 7 is a flowchart showing a control process according to a second embodiment.

FIG. 7 is a flowchart showing a control process according to the second embodiment. In the second embodiment, the controller 3 controls the posture of the rotating shaft 42 according to the sway of the boat 100. As illustrated in FIG. 7, in step S201, the controller 3 detects the sway of the boat 100, as in step S101.

In step S202, the controller 3 determines the target moment of inertia of the rotating shaft 42 according to the sway of the boat 100. In step S203, the controller 3 determines the target rotation speed of the rotating shaft 42. The controller 3 may determine the target rotation speed of the rotating shaft 42 according to the target moment of inertia, as in step S103. Alternatively, the target rotation speed may be a fixed value.

In step S204, the controller 3 determines the target posture angle of the rotating shaft 42. The target posture angle may be the tilt angle of the outboard motor 2. The target posture angle may be the steering angle of the outboard motor 2. Alternatively, the target posture angle may be both the tilt angle and the steering angle of the outboard motor 2. The controller 3 determines the target posture angle according to the direction of the sway.

Figure 8:
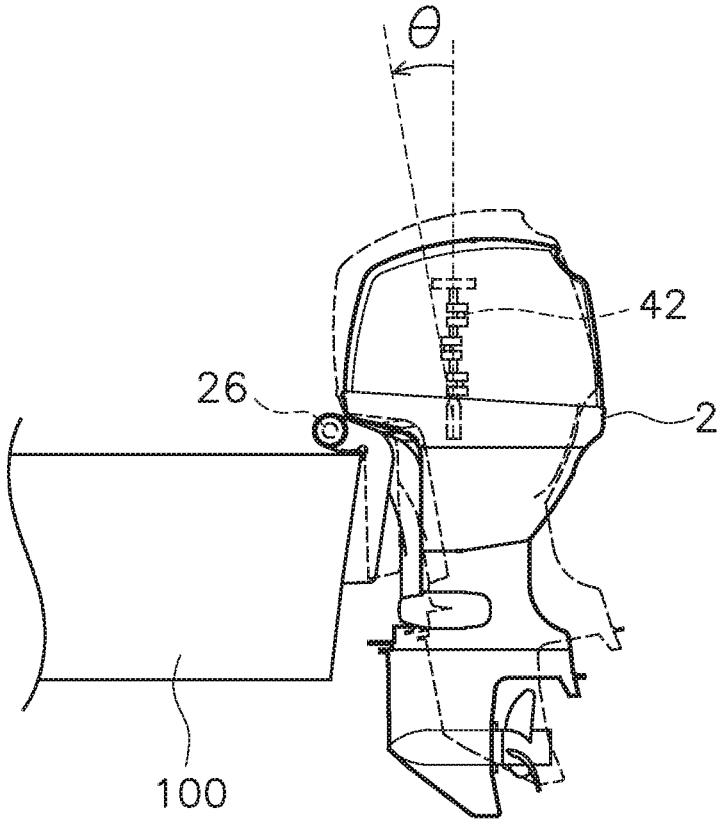
FIG. 8 is a side view showing an operation of the outboard motor under the control of the second embodiment.

For example, when the direction of the sway of the boat 100 is the roll direction, the controller 3 controls the tilt angle of the outboard motor 2. Specifically, when the direction of the sway of the boat 100 is the direction in which the starboard side is raised, the controller 3 determines the target posture angle so that the rotating shaft 42 tilts forward as illustrated in FIG. 8. Conversely, when the direction of the sway of the boat 100 is the direction in which the port side is raised, the controller 3 determines the target posture angle so that the rotating shaft 42 tilts backward. The controller 3 may control the changing speed of the target posture angle according to the magnitude of the sway of the boat 100.

In step S205, the controller 3 outputs the power command signal for the power source 11 as in step S104. In step S206, the controller 3 outputs a posture command signal for changing the posture of the outboard motor 2. After that, the controller 3 repeats the processes of steps S201 to S206. Specifically, the controller 3 outputs a signal indicative of the target tilt angle to the tilt actuator 39. The controller 3 operates the tilt actuator 39 to control the tilt angle of the outboard motor 2 according to the direction of the sway of the boat 100. As a result, the angular velocity of the posture change of the rotating shaft 42 increases, and the damping effect of the boat 100 due to the moment of the rotating shaft 42 can be improved.

Figure 9:
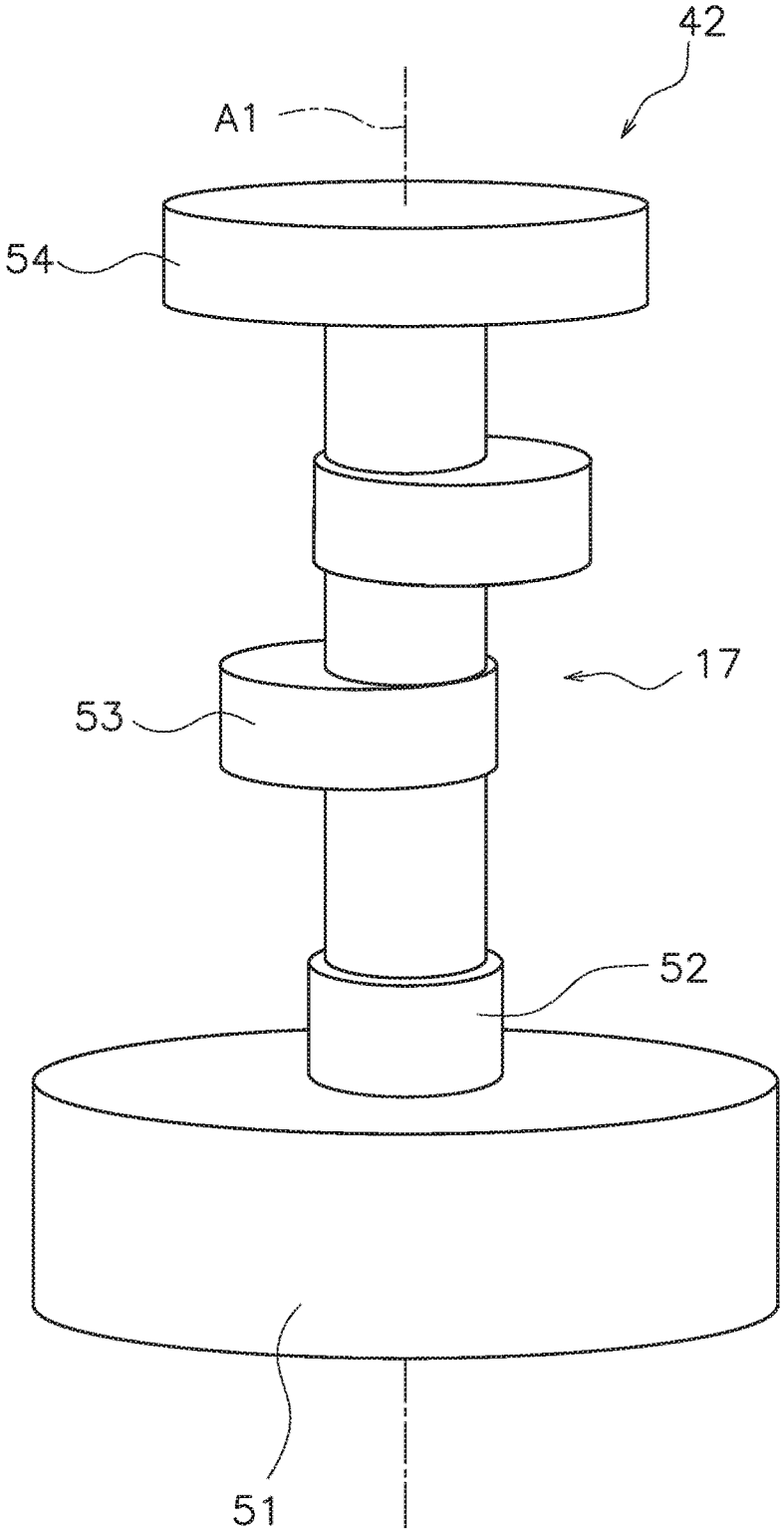
FIG. 9 is a side view of the rotating shaft of the outboard motor according to a third embodiment.

FIG. 9 is a side view of the rotating shaft 42 of the outboard motor 2 according to the third embodiment. The outboard motor 2 according to the third embodiment further includes a weight 51 and a clutch 52. The weight 51 is connected to the rotating shaft 42 and thus rotates integrally with the rotating shaft 42. As a result, the weight 51 increases the moment of inertia of the rotating shaft 42. The weight 51 may have a larger outer diameter than the rotating shaft 42. The weight 51 may have a larger outer diameter than the cam 53 of the crankshaft 17. The weight 51 may be heavier than the rotating shaft 42. The weight 51 may be heavier than the flywheel 54 connected to the crankshaft 17. The clutch 52 switches connection and disconnection between the rotating shaft 42 and the weight 51. The weight 51 is connected to the rotating shaft 42 when the clutch 52 is in the connected state. The weight 51 is released from the rotating shaft 42 when the clutch 52 is in the released state.

Figure 10:
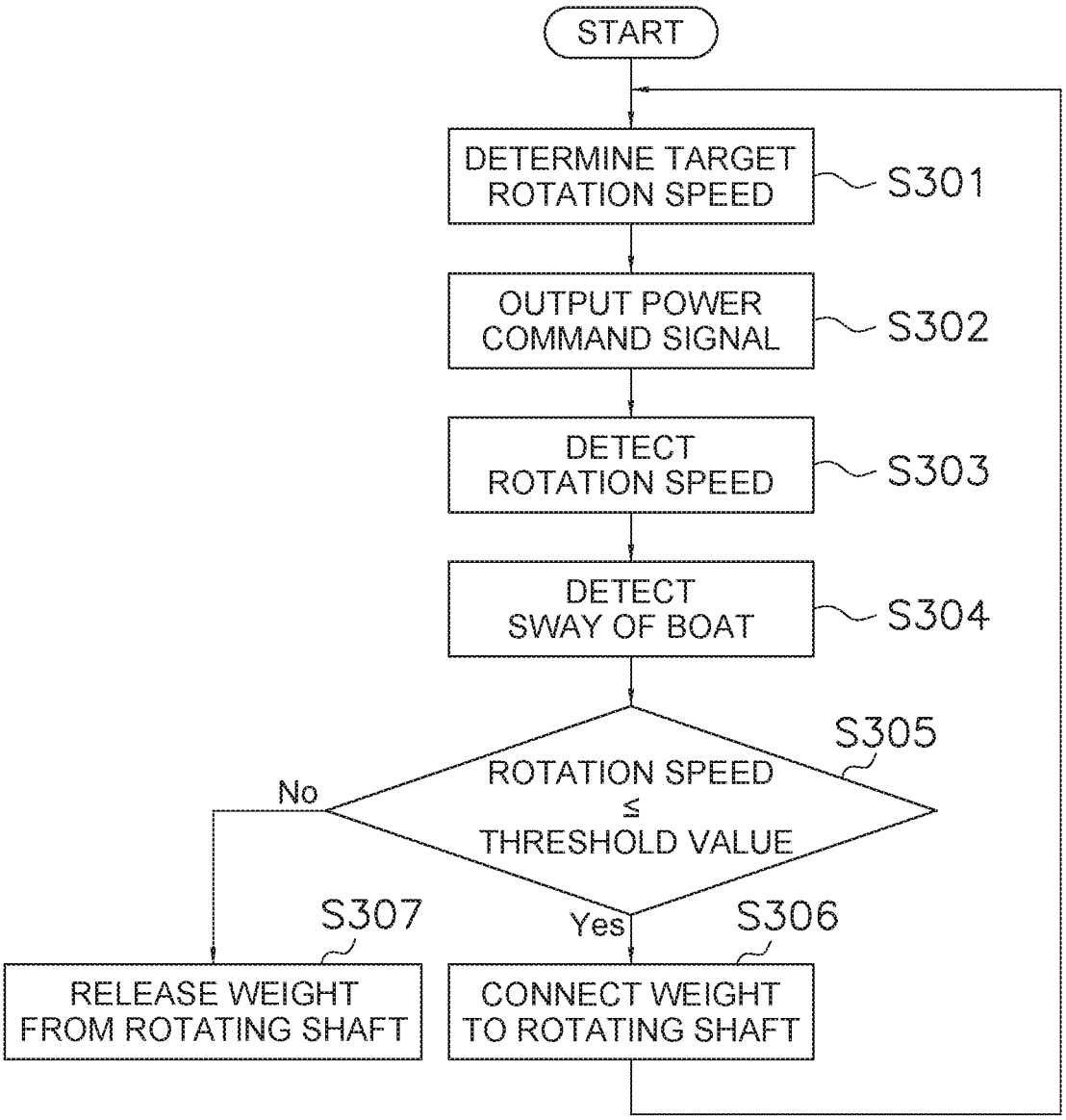
FIG. 10 is a flowchart showing a control process according to the third embodiment.

FIG. 10 is a flowchart showing a control process according to the third embodiment. In the third embodiment, the controller 3 controls the moment of inertia of the rotating shaft 42 according to the sway of the boat 100. As illustrated in FIG. 10, in step S301, the controller 3 determines the target rotation speed of the rotating shaft 42. The controller 3 determines the target rotation speed of the rotating shaft 42 according to the operation signal from the propulsion operation device 33. In step S302, the controller 3 outputs a power command signal for the power source 11 as in step S203. In step S303, the controller 3 detects the rotation speed of the rotating shaft 42. The controller 3 detects the rotation speed of the rotating shaft 42 from the detection signal from the rotation speed sensor 35.

In step S304, the controller 3 detects the sway of the boat 100, as in step S101. In step S305, the controller 3 determines whether the rotation speed of the rotating shaft 42 is equal to or less than a threshold value. When the rotation speed of the rotating shaft 42 is equal to or lower than the threshold value, the process proceeds to step S306. In step S306, the controller 3 connects the weight 51 to the rotating shaft 42 and increases the moment of inertia of the rotating shaft 42. As a result, the moment for canceling the sway of the boat 100 is increased, and the sway of the boat 100 is reduced.

When the rotation speed is larger than the threshold value in step S305, the process proceeds to step S307. In step S307, the controller 3 controls the clutch 52 to release the weight 51 from the rotating shaft 42. After that, the controller 3 repeats the processes of steps S301 to S307.

The controller 3 may control the clutch 52 to release the weight 51 from the rotating shaft 42 when the controller 3 receives a command signal to accelerate the boat 100 with the weight 51 connected to the rotating shaft 42. As a result, when the boat 100 is accelerated, the moment of inertia of the rotating shaft 42 is reduced. The controller 3 may determine that the command signal to accelerate the boat 100 is received when the operation amount of the propulsion operation device 33 is larger than a predetermined threshold value. For example, the controller 3 may release the weight 51 from the rotating shaft 42 when the operation amount of the propulsion operation device 33 is larger than a predetermined threshold value. The controller 3 may connect the weight 51 to the rotating shaft 42 when the operation amount of the propulsion operation device 33 is equal to or less than the predetermined threshold value.

The controller 3 may determine whether to connect the weight 51 to the rotating shaft 42 before detecting the sway of the boat. Thereby, the moment of inertia can be increased in advance.

Although one embodiment of the present invention has been described above, the present invention is not limited to the above embodiment, and various modifications can be made without departing from the scope of the invention. For example, the configuration of the outboard motor 2 is not limited to that of the above embodiment and may be changed. For example, the configuration of the outboard motor 2 is not limited to that of the above embodiment and may be changed. The power source 11 is not limited to the internal combustion engine and may be an electric motor.

Figure 11:
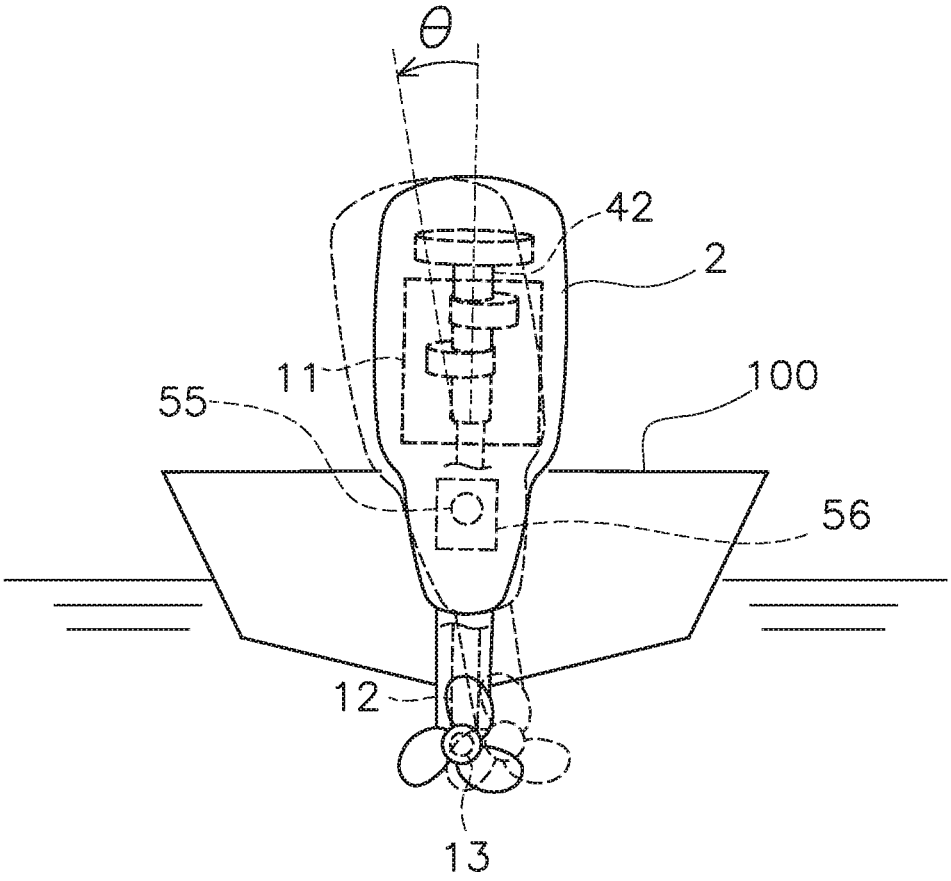
FIG. 11 is a rear view showing the outboard motor according to a first modification.

FIG. 11 is a rear view showing the outboard motor 2 according to a first modification. As illustrated in FIG. 11, the outboard motor 2 further includes a roll shaft 55 and a roll actuator 56. The roll shaft 55 extends in the front-rear direction of the outboard motor 2. The bracket 25 described above supports the outboard motor 2 rotatably around the roll shaft 55. The roll actuator 56 is, for example, an electric motor. Alternatively, the roll actuator 56 may be another actuator such as a hydraulic motor or a hydraulic cylinder. The roll actuator 56 rotates the outboard motor 2 around the roll shaft 55. The controller 3 controls the roll actuator 56 to change the roll angle of the outboard motor 2. The roll angle is an angle of inclination of the drive shaft 12 in the left-right direction with respect to the vertical direction.

In the first modification, the controller 3 controls the roll angle of the rotating shaft 42 according to the sway of the boat 100. That is, the controller 3 determines the roll angle of the rotating shaft 42 as the target posture angle. For example, when the direction of the sway of the boat 100 is the pitch direction, the controller 3 controls the roll angle of the outboard motor 2 as illustrated in FIG. 11. Specifically, when the direction of the sway of the boat 100 is the direction in which the bow of the boat 100 is raised, the controller 3 determines the target posture angle so that the rotating shaft 42 tilts to the port side. On the contrary, when the direction of the sway of the boat 100 is the direction in which the bow of the boat 100 is lowered, the controller 3 determines the target posture angle so that the rotating shaft 42 tilts to the starboard side. The controller 3 may control the changing speed of the target posture angle according to the magnitude of the sway of the boat 100. Other processes are the same as those in the second embodiment.

Figure 12:
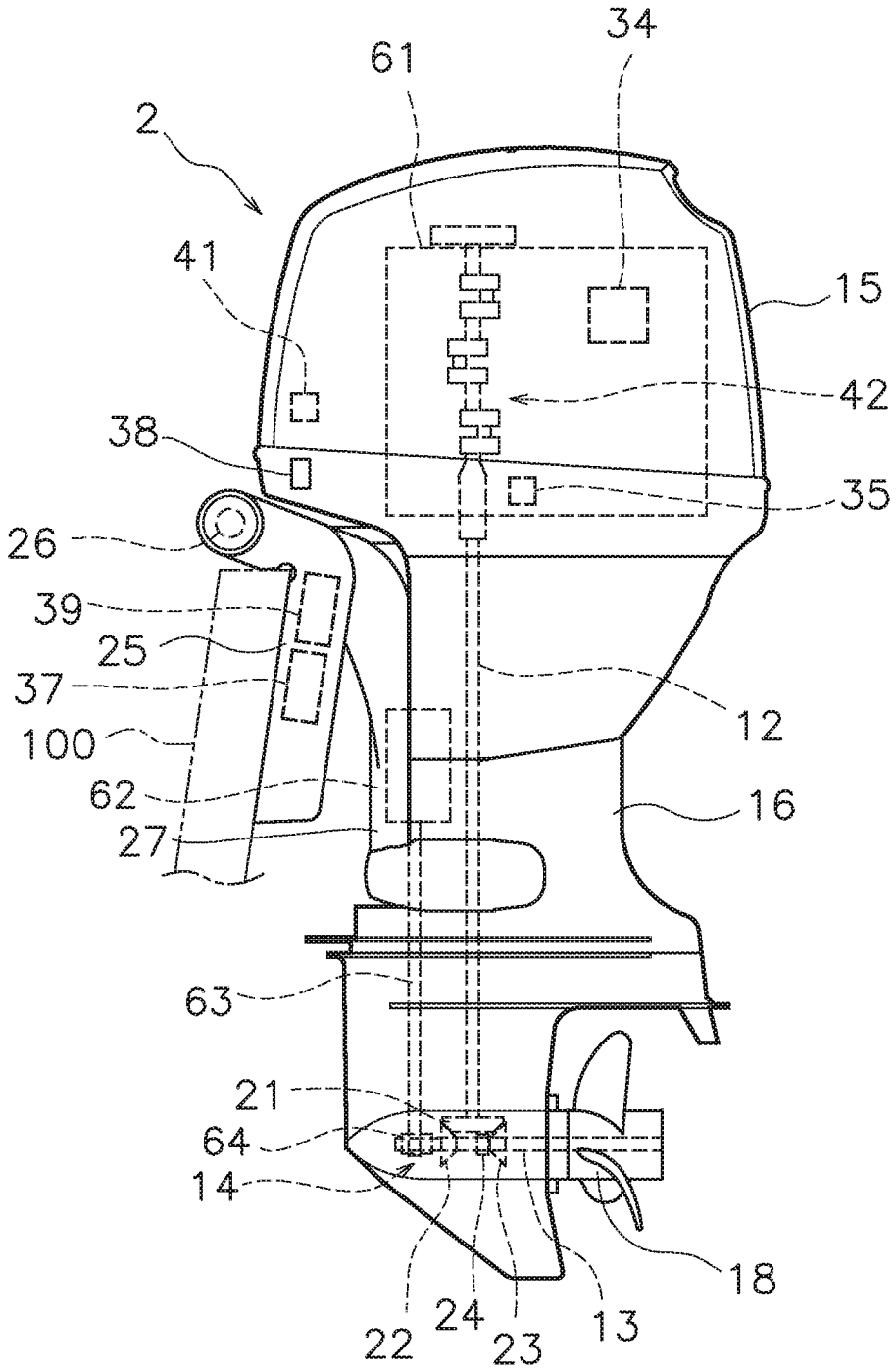
FIG. 12 is a side view showing an outboard motor according to a second modification.

FIG. 12 is a side view showing the outboard motor 2 according to a second modification. As illustrated in FIG. 12, the outboard motor 2 further includes a first power source 61, a second power source 62, a motor shaft 63, and a motor clutch 64. The first power source 61 has the same configuration as the power source 11 described above. The first power source 61 is an internal combustion engine. The second power source 62 is an electric motor. The motor shaft 63 is connected to the second power source 62. The motor shaft 63 extends in the vertical direction of the outboard motor 2. The motor clutch 64 switches connection and disconnection between the motor shaft 63 and the propeller shaft 13. The motor clutch 64 is movable between a connection position and a disengaged position. The motor clutch 64 connects the motor shaft 63 and the propeller shaft 13 at the connection position. The motor clutch 64 disengages the motor shaft 63 from the propeller shaft 13 at the disengaged position. The motor clutch 64 may be configured to interlock with the shift clutch 24. Alternatively, the motor clutch 64 may be configured to operate independently of the shift clutch 24.

The controller 3 controls the shift clutch 24 and the motor clutch 64 to switch the outboard motor 2 between the first propulsion state and the second propulsion state. In the first propulsion state, the outboard motor 2 rotates the propeller shaft 13 by the first power source 61. In the second propulsion state, the outboard motor 2 rotates the propeller shaft 13 by the second power source 62. In the first propulsion state, the controller 3 positions the shift clutch 24 in the forward position or the reverse position and also positions the motor clutch 64 in the disengaged position. As a result, the driving force from the first power source 61 is transmitted to the propeller shaft 13 via the drive shaft 12. In the second propulsion state, the controller 3 positions the shift clutch 24 in the neutral position and the motor clutch 64 in the connected position. As a result, the driving force from the second power source 62 is transmitted to the propeller shaft 13 via the motor shaft 63. The controller 3 may automatically perform the switching between the first propulsion state and the second propulsion state. Alternatively, the controller 3 may switch between the first propulsion state and the second propulsion state in response to a manual operation by an operator.

The controller 3 transitions the outboard motor 2 to the second propulsion state when executing the control for reducing the sway of the boat 100. Thereby, the moment of inertia for reducing the sway of the boat 100 due to the rotation of the rotating shaft 42 is obtained. Further, the controller 3 controls the second power source 62 to propel the boat 100. In this case, the control according to any of the above-described embodiments or modifications may be executed.

Figure 13:
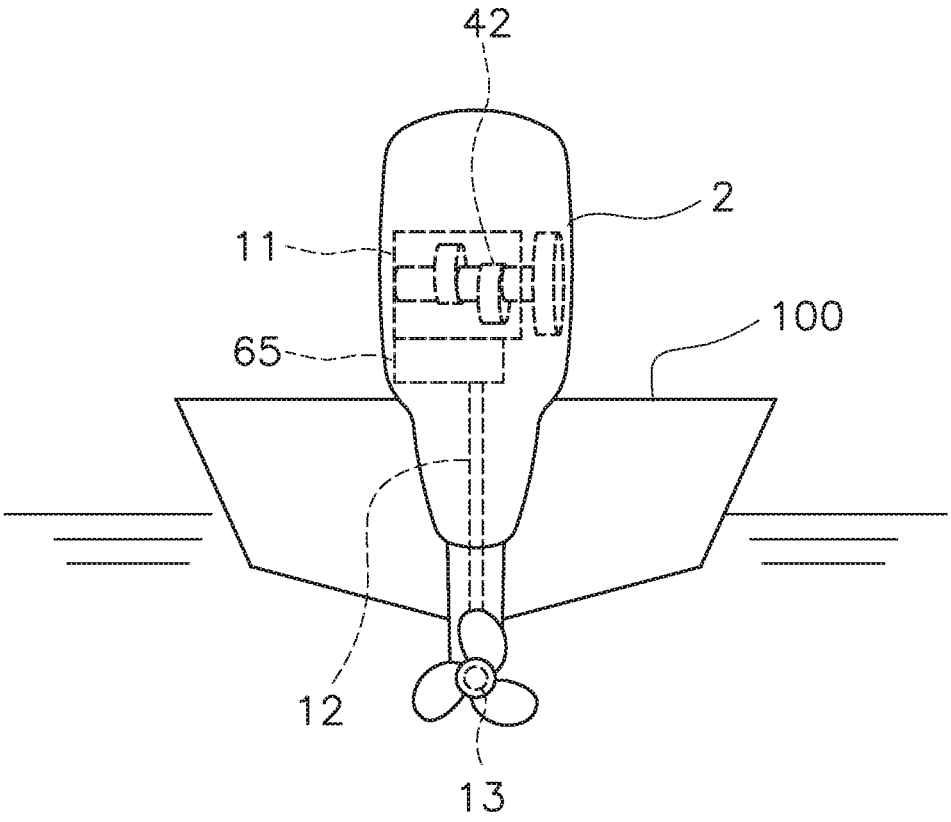
FIG. 13 is a rear view showing the outboard motor according to a third modification.

FIG. 13 is a rear view showing the outboard motor 2 according to a third modification. As illustrated in FIG. 13, in the third modification, the rotating shaft 42 extends in the left-right direction of the outboard motor 2. The outboard motor 2 includes a transmission 65. The transmission 65 transmits the rotation of the rotating shaft 42 to the drive shaft. In this case as well, similar to the above-described embodiments or modifications, the moment of inertia for reducing the sway of the boat 100 is obtained by the rotation of the rotating shaft 42.

Figure 14:
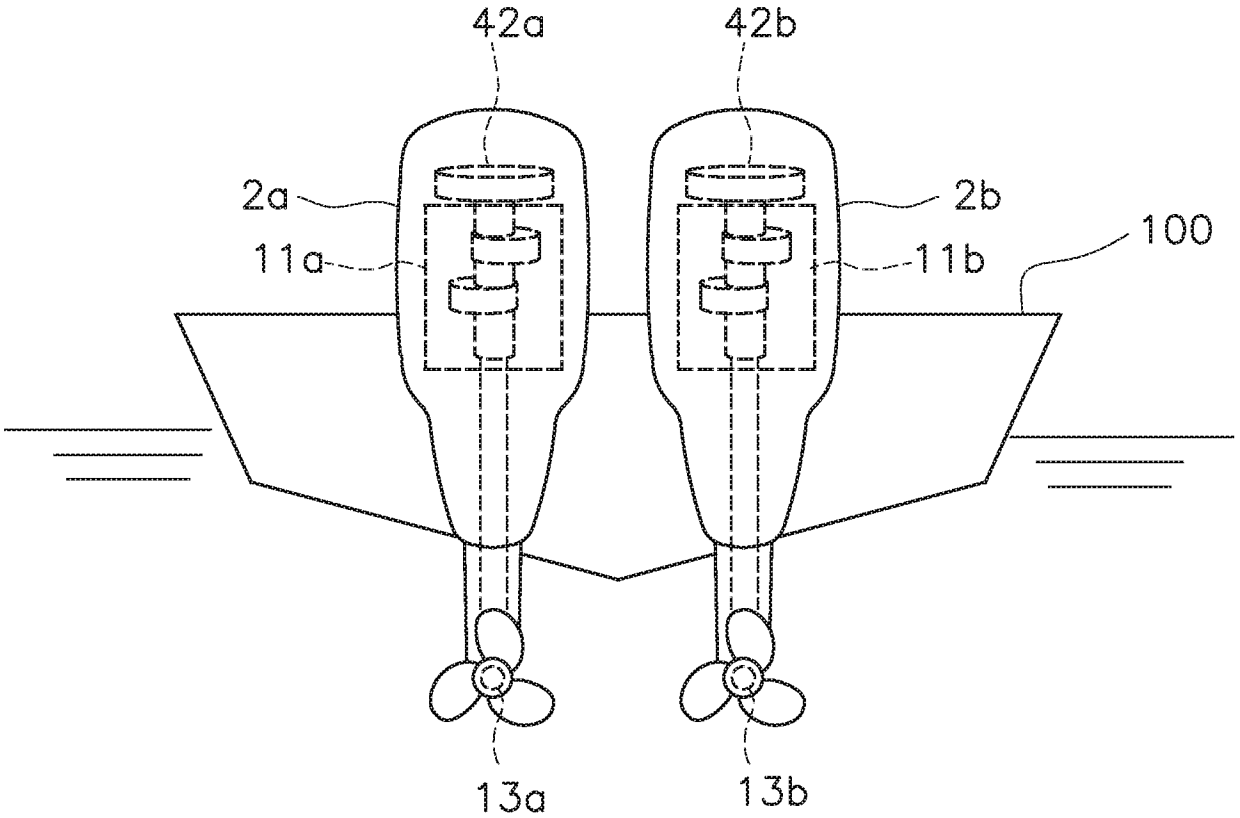
FIG. 14 is a rear view of a boat equipped with the control system according to a fourth modification.

FIG. 14 is a rear view of the boat 100 equipped with the control system 1 according to a fourth modification. The control system 1 includes a first outboard motor 2*a* and a second outboard motor 2*b*. The first outboard motor 2*a* includes a first power source 11*a* and a first propeller shaft 13*a*. The first power source 11*a* includes a first rotating shaft 42*a*. The first propeller shaft 13*a* is connected to the first rotating shaft 42*a*. The second outboard motor 2*b* includes a second power source 11*b* and a second propeller shaft 13*b*. The second power source 11*b* includes a second rotating shaft 42*b*. The second propeller shaft 13*b* is connected to the second rotating shaft 42*b*. The detailed configurations of the first outboard motor 2*a* and the second outboard motor 2*b* are the same as those of the outboard motor 2 according to the above-described embodiments or modifications.

In the fourth modification, the controller 3 controls at least one of a first moment of inertia of the first rotating shaft 42*a*, a first rotation speed, and a first posture, and at least one of a second moment of inertia of the second rotating shaft 42*b*, and a second rotation speed, and a second posture according to the sway of the boat 100 to generate a moment of inertia against the sway of the boat 100. The first moment of inertia is a moment of inertia of the first rotating shaft 42*a* around the first rotating shaft 42*a*. The first rotation speed is a rotation speed of the first rotating shaft 42*a*. The first posture is a posture of the first rotating shaft 42*a*. The second moment of inertia is a moment of inertia of the second rotating shaft 42*b* around the second rotating shaft 42*b*. The second rotation speed is a rotation speed of the second rotating shaft 42*b*. The second posture is a posture of the second rotating shaft 42*b*. The controller 3 may control the first outboard motor 2*a* and the second outboard motor 2*b* by the same processing as that of the above-described embodiments or modifications. Although the number of the outboard motors 2 is two in the fourth modification, the number of the outboard motors 2 is not limited to two and may be more than two.

The controller 3 may execute the control according to the above-described embodiments or modifications in combination. For example, the controller 3 may combine the control of the moment of inertia of the rotating shaft 42 and the control of the rotation speed. The controller 3 may combine the control of the moment of inertia of the rotating shaft 42 and the control of the posture. The controller 3 may combine the control of the rotation speed of the rotating shaft 42 and the control of the posture. The controller 3 may combine the control of the moment of inertia of the rotating shaft 42, the control of the rotation speed, and the control of the posture.

What is claimed is:

1. A control system for reducing sway of a boat, the control system comprising:
- an outboard motor including a power source and a propeller shaft, the power source including a rotating shaft, the propeller shaft being connected to the rotating shaft;
- a sway sensor that outputs a signal indicative of the sway of the boat; and
- a controller communicatively connected to the sway sensor, the controller being configured to
  - receive the signal indicative of the sway of the boat from the sway sensor, and
  - control at least one of a moment of inertia about the rotating shaft or a tilt angle of the rotating shaft according to the sway of the boat, to generate an inertial force against the sway of the boat.

2. The control system according to claim 1, wherein
- the controller is further configured to control the moment of inertia about the rotating shaft according to a magnitude and/or a direction of the sway of the boat.

3. The control system according to claim 2, further comprising:
- a weight that is connectable to the rotating shaft to increase the moment of inertia; and
- a clutch configured to switch between connection and release of the rotating shaft and the weight.

4. The control system according to claim 3, further comprising:
- a rotation speed sensor that detects a rotation speed of the rotating shaft, wherein
- the controller is further configured to
  - control the clutch to release the weight from the rotating shaft when the rotation speed of the rotating shaft is larger than a threshold value, and
  - control the clutch to connect the weight to the rotating shaft when the rotation speed of the rotating shaft is less than or equal to the threshold value.

5. The control system according to claim 3, wherein the controller is further configured to control the clutch to release the weight from the rotating shaft when the controller receives a command signal to accelerate the boat.

6. A control system for reducing sway of a boat, the control system comprising:
- an outboard motor including a power source and a propeller shaft, the power source including a rotating shaft, the propeller shaft being connected to the rotating shaft;
- a sway sensor that outputs a signal indicative of the sway of the boat; and
- a controller communicatively connected to the sway sensor, the controller being configured to
  - receive the signal indicative of the sway of the boat from the sway sensor, and
  - control at least one of a moment of inertia about the rotating shaft, a rotation speed of the rotating shaft, or a tilt angle of the rotating shaft according to the sway of the boat, to generate an inertial force against the sway of the boat;

a first clutch configured to switch between connection and disengagement of the rotating shaft and the propeller shaft, wherein the controller is further configured to control the rotation speed of the rotating shaft according to a magnitude and/or a direction of the sway of the boat while controlling the first clutch to release the propeller shaft from the rotating shaft.

7. The control system according to claim 6, further comprising:

a motor; and a second clutch configured to switch between connection and disengagement of the motor and the propeller shaft, wherein the controller is further configured to control the motor to propel the boat while controlling the second clutch to connect the propeller shaft to the motor.

8. The control system according to claim 1, wherein the controller is further configured to control the tilt angle of the rotating shaft according to a magnitude and/or a direction of the sway of the boat.

9. The control system according to claim 8, further comprising:

a bracket attached to the outboard motor, the bracket including a tilt shaft extending in a left-right direction of the outboard motor; and a tilt actuator configured to move the outboard motor around the tilt axis, wherein the controller is further configured to operate the tilt actuator to control the tilt angle of the rotating shaft according to the sway of the boat.

10. The control system according to claim 8, further comprising:

a bracket attached to the outboard motor, the bracket including a steering shaft extending in a vertical direction of the outboard motor; and a steering actuator configured to move the outboard motor around the steering shaft, wherein the controller is further configured to operate the steering actuator to control the tilt angle of the rotating shaft according to the sway of the boat.

11. The control system according to claim 8, further comprising:

a bracket attached to the outboard motor, the bracket including a roll shaft extending in a front-rear direction of the outboard motor; and a roll actuator configured to operate the outboard motor around the roll axis, wherein the controller is further configured to operate the roll actuator to control the tilt angle of the rotating shaft according to the sway of the boat.

12. The control system according to claim 1, wherein the rotating shaft extends in a vertical direction of the outboard motor.

13. The control system according to claim 1, wherein the rotating shaft extends in a left-right direction of the outboard motor.

14. A control system for reducing sway of a boat, the control system comprising:

a first outboard motor including a first power source and a first propeller shaft, the first power source including a first rotating shaft, the first propeller shaft being connected to the first rotating shaft;

a second outboard motor including a second power source and a second propeller shaft, the second power source including a second rotating shaft, the second propeller shaft being connected to the second rotating shaft;

a sway sensor that outputs a signal indicative of the sway of the boat; and a controller communicatively connected to the sway sensor, the controller being configured to receive the signal indicative of the sway of the boat from the sway sensor, control at least one of a moment of inertia about the first rotating shaft, a rotation speed of the first rotating shaft, or a tilt angle of the first rotating shaft, or at least one of a moment of inertia about the second rotating shaft or a tilt angle of the second rotating shaft according to the sway of the boat, to generate an inertial force against the sway of the boat.

15. A method for controlling an outboard motor to reduce sway of a boat, the outboard motor including a power source and a propeller shaft, the power source including a rotating shaft, the propeller shaft being connected to the rotating shaft, the method comprising:

receiving a signal indicative of the sway of the boat; and controlling at least one of a moment of inertia about the rotating shaft or a tilt angle of the rotating shaft according to the sway of the boat, to generate an inertial force against the sway of the boat.

* * * * *